United States Patent [19]

Yamamoto et al.

[11] 4,385,887

[45] May 31, 1983

[54] COMBUSTION CONTROL APPARATUS

[75] Inventors: Yoshio Yamamoto; Yukio Nagaoka, both of Nara; Yoshiyuki Yokoajiro, Yamato Koriyama, all of Japan

[73] Assignee: Matsushita Electric Industrial Co., Ltd., Osaka, Japan

[21] Appl. No.: 268,758

[22] Filed: Jun. 1, 1981

Related U.S. Application Data

[63] Continuation of Ser. No. 29,379, Apr. 12, 1979, abandoned.

[30] Foreign Application Priority Data

Apr. 17, 1978 [JP] Japan ..... 53-45502

[51] Int. Cl.[3] ..... F23N 1/02

[52] U.S. Cl. ..... 431/90; 137/484.8

[58] Field of Search ..... 431/89, 90; 137/484.4, 137/484.8

[56] References Cited

U.S. PATENT DOCUMENTS

| | | | |
|---|---|---|---|
| 2,305,975 | 12/1942 | McKinley | 137/484.6 |
| 2,859,807 | 11/1958 | Newman et al. | 431/90 X |
| 2,962,094 | 11/1960 | Wallace | 431/90 X |
| 3,269,450 | 8/1966 | Licata et al. | 431/90 X |
| 3,404,702 | 10/1968 | Telford | 431/90 X |
| 3,773,071 | 11/1973 | Stang, Jr. | 137/484.8 |

FOREIGN PATENT DOCUMENTS

| | | | |
|---|---|---|---|
| 1405093 | 9/1975 | United Kingdom | 431/90 |

OTHER PUBLICATIONS

Gas Engineers, Handbook, 1966, Chapter 13, pp. 12/211–12/231.

I.G.E. Journal, Jun. 1965, pp. 470–489.

North American Mfg. Co., Instructions 72.18, Nov. 1965, Bulletin 73.37, Aug. 1966, Bulletin 73.49, Jun. 1966.

*Primary Examiner*—Samuel Scott

*Assistant Examiner*—Randall L. Green

*Attorney, Agent, or Firm*—Joseph W. Farley

[57] ABSTRACT

A combustion control apparatus comprises a premix combustion burner requiring primary air, an injector disposed in a primary air passage and including a constricted section having a fixed diameter and length, an enlarged section communicating with the constricted section and a fuel injecting port disposed concentrically with the constricted section and in a predetermined region, and a pressure regulator disposed in a fuel feed passage communicating with the fuel injecting port, the arrangement being such that the pressure regulator is controlled so that the pressure difference between the outlet section of the pressure regulator and the inlet section of the injector may be within the fixed range of the pressure difference produced between the inlet and constricted sections of the injector on the basis of the amount of primary air at the time of the lowest input, thereby maintaining the ratio between the amounts of air and fuel at a constant value and securing combustion stability and high combustion efficiency. Particularly, the apparatus is characterized in that it is highly effective even if the fuel pressure and air pressure are low.

2 Claims, 12 Drawing Figures

COMBUSTION CONTROL APPARATUS

This is a continuation of application Ser. No. 29,379, filed Apr. 12, 1979 and abandoned.

The present invention relates to a forced air feed type combustion apparatus using a blower for feeding air for combustion.

A conventional forced air feed type combustion apparatus includes a burner disposed in a passage including a blower for feeding air to the burner. Generally, no consideration has been given to establishing a connection between the air side and the fuel side. In such apparatus, variations in the blower voltage, in the air feed passage resistance and in the force of the outside air acting on the air feed port and exhaust port cause variations in the amount of air being blown or in the internal pressure of the apparatus, thus making it impossible to maintain the excess air ratio at a constant value. Further, when it is desired to vary the amount of combustion, it is necessary to change the number of burners or the fuel feed pressure, resulting in a wide variation in excess air ratio. As a result, it is necessary to select such a burner as will allow wide variations in excess air ratio, which means increasing the burner size. Further, if the amount of combustion is adjusted to a low value, the excess air ratio will sharply increase and hence the combustion efficiency will decrease.

Examples of the arrangement for combustion while controlling the excess air ratio include combustion apparatuses for industrial use, such as heating furnaces and heat-treating furnaces. These apparatuses use high pressure blowers of more than several hundred mm aq. If the fuel is gas, it is fed from a medium pressure pipeline or it is fed after being pressurized by a booster. Consequently, such apparatus has been increased in size and has not been usable in homes where low pressure gas is supplied.

The present invention eliminates the disadvantages described above, and the combustion apparatus is designed to maintain excess air ratio within a fixed range, thereby securing combustion stability and assuring that the combustion efficiency will not be decreased even in the case of adjusting the amount of combustion. Particularly, it is an object of the invention to reduce pressure loss in an air feed passage to an air-fuel mixing section, thereby making it possible to reduce the blower size and hence making the entire combustion apparatus small in size and light in weight.

An embodiment of the invention will be described with reference to the accompanying drawings.

Figure 1:
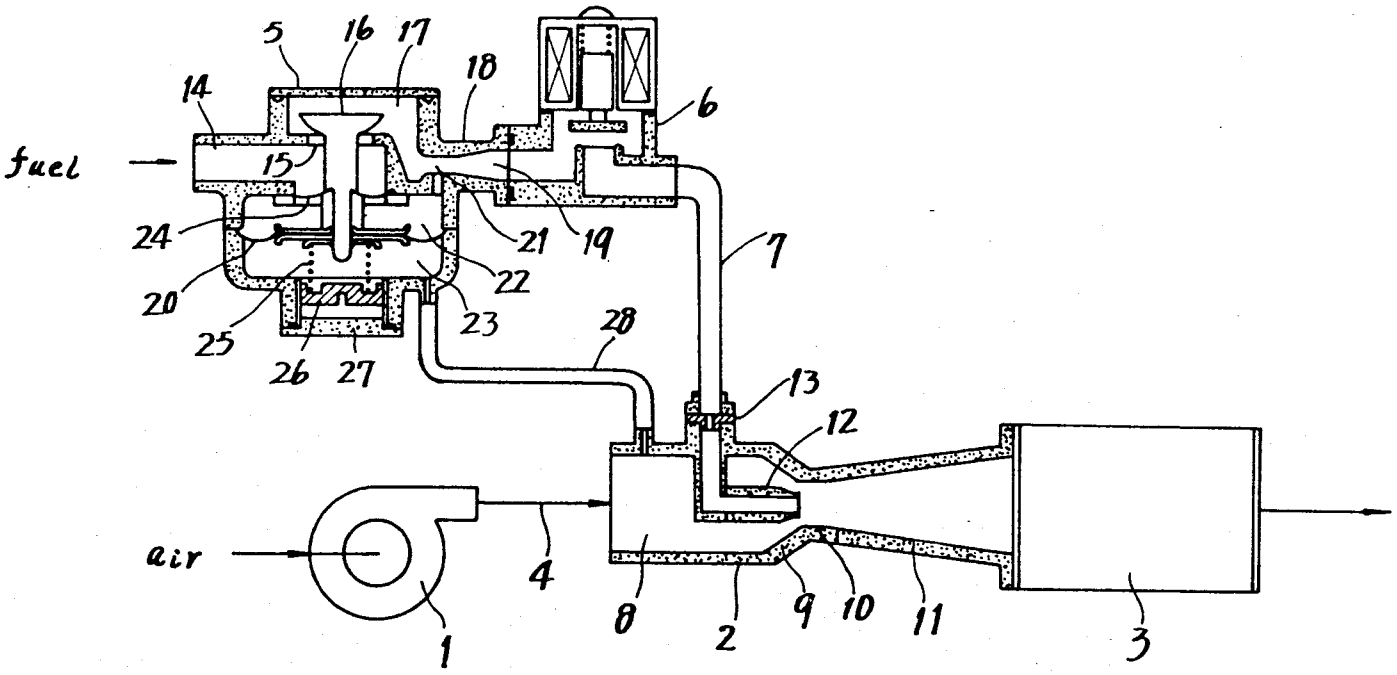
FIG. 1 is a sectional view of an embodiment of the invention.

Referring to FIG. 1, a blower 1 for feeding air for combustion has an air feed passage 4 in which an injector 2 is disposed, and fuel and air are mixed in said injector 2 and fed to a premix combustion burner 3 for combusting the same. On the other hand, the fuel is controlled by a pressure regulator 5 to pass through a solenoid on-off valve 6 and a fuel feed passage 7 to the injector 2. The injector 2 comprises an inlet section 8 disposed in the upstream part of the air stream, a flow contracting section 9 extending therefrom with its diameter gradually reduced, a constricted section 10, and an enlarged section 11 communicating with said constricted section 10 and having its diameter gradually increased, said sections being axially aligned with each other. Opening in the downstream direction and disposed concentrically with the constricted section 10 is a fuel injecting port 22 or nozzle which is connected to said fuel feed passage 7. Thus, in the constricted section 10, fuel and air are spouting from the central region and peripheral region, respectively, and they flow while being mixed. Such mixing is accelerated in the enlarged section and the pressure is restored. The numeral 13 designates a nozzle which sets the amount of fuel to be injected.

Referring to the fuel feed side, fuel enters the inlet 14 of the pressure regulator 5 and flows through a control valve composed of a valve port 15 and a valve body 16 and into a valve chamber 17. It then flows through a pressure difference producer 18 having its outlet 19 connected to the solenoid on-off valve 6. A main diaphragm 20 serves to move the valve body 16. On one side of said main diaphragm, there is a diaphragm chamber 22 acted upon by the fuel pressure in the low pressure section 21 of the pressure difference producer 18, while on the other side, there is a back pressure chamber 23 to which the air pressure in the inlet section 8 of the injector 2 is admitted through an equalizing pipe 28. A balance diaphragm 24 has substantially the same effective diameter as the valve port 15 and separates the fuel inlet 14 and the diaphragm chamber 22 from each other. An adjusting spring 25 is supported on an adjusting screw 26 and acts on the main diaphragm 20. Designated at 27 is a blind cap for preventing leakage from the adjusting screw 26.

The operation of the combustion control apparatus arranged in the manner described above will now be described.

In FIG. 1, air necessary for combustion is fed by the blower 1 while fuel whose pressure is adjusted by the pressure regulator 5 in relation to the amount of said air is injected through the fuel injecting port 12 upon opening of the on-off valve 6, so that it is mixed with the air and the mixture is fed to the premix combustion burner 3, where combustion is carried out. In this connection, the ratio between the amounts of fuel and air is set to such an excess air ratio as will assure perfect combustion to provide the highest thermal efficiency, and the fuel input control is effected by changing the flow rate of air being blown but even then the optimum excess air ratio is retained. Heretofore, this type of control mechanism has been put exclusively to industrial use where the pressure loss at the injector 2 poses no problem since the air and fuel feed pressures are both greater than several hundred mm aq., in order to maintain the air-fuel ratio at a constant value. In ordinary homes, since it is impossible to obtain such high pressures, it has been considered impossible to control excess air ratio. The present invention provides improvements in this regard and adapts said apparatus for domestic use.

Figure 2:
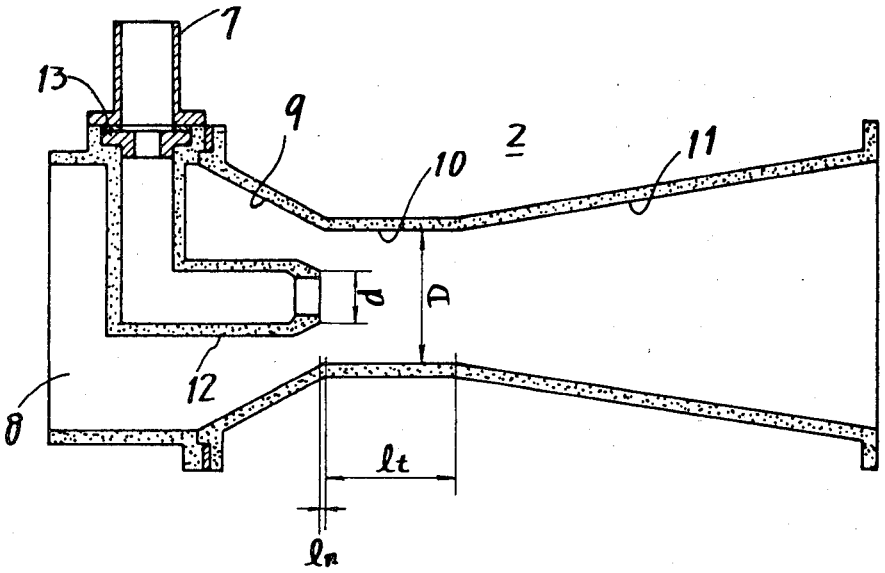
FIG. 2 is a sectional view of an injector.
Figure 3:
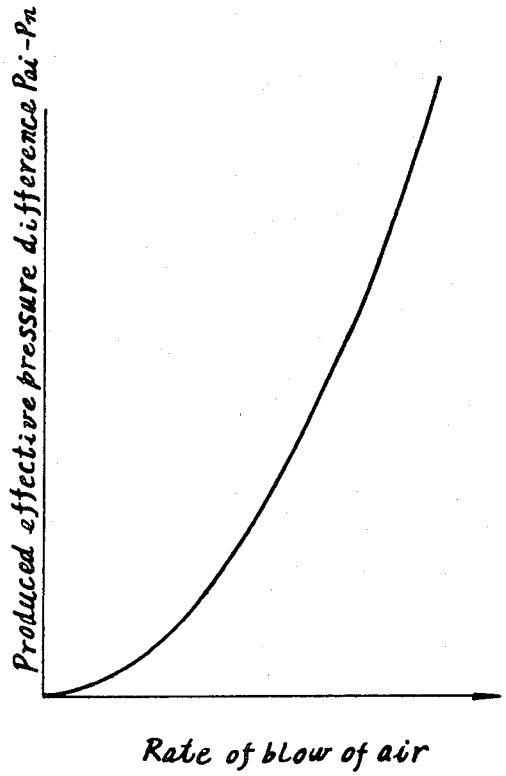
FIG. 3 is a graph showing the relation between air speed and produced effective pressure difference at the injector.

Referring to FIG. 2 showing an enlarged sectional view of the injector 2, air for combustion enters the inlet section 8 and flows to the enlarged section 11, whereby the pressure in the constricted section 10 is reduced. The pressure difference between the inlet section 8 and the constricted section 10 is determined by the speed of air passing through an annular air passage defined between the fuel injecting port 12 and the constricted section 10 and is as shown in FIG. 3. Mathematically, $$Pai-Pn=ka(Vc)^2=Ka(Qc)^2 \quad (1)$$

Pai: Pressure in inlet section 8
Pn: Pressure in constricted section 10
Vc: Air injection speed
Qc: Amount of air Ka is a constant determined by the size and shape of the flow contracting section 9 and constricted section 10. The pressure Pn in the constricted section 10 given above is not the pressure acting on the wall of the constricted section 10 but the effective pressure acting on the fuel injecting port 12.

Referring to the pressure regulator 5, the flow rate of fuel is determined by the pressure in the outlet section 19 thereof and said pressure Pn in the constricted section. The relation is as indicated by the following equation (2).

$$Qg = Kg\sqrt{Pgo - Pn} \quad (2)$$

Qg: Flow rate of fuel
Pgo: Pressure at outlet 19 of pressure regulator 5

Kg is a constant determined by the size and shape of the on-off valve 6 and orifice 13 in the fuel feed passage 7 and by the specific gravity of the fuel.

In combustion burners, excess air ratio defined as the ratio of the amount of air to the theoretical amount of air becomes a problem, the relation being as follows.

$$M = \frac{Qc}{q \cdot Qg} \quad (3)$$

M: Excess air ratio
q: theoretical amount of air per unit flow rate of fuel

Substituting equations (1) and (2) in equation (3) gives $$M = \frac{Qc}{q \cdot Qg} = \frac{\sqrt{\frac{1}{Ka}(Pai - Pn)}}{q \cdot Kg\sqrt{Pgo - Pn}} = \frac{1}{q \cdot Kg\sqrt{Ka}}\sqrt{\frac{Pai - Pn}{Pgo - Pn}} = K\sqrt{\frac{Pai - Pn}{Pgo - Pn}} \quad (4)$$

where $$K = \frac{1}{qKg\sqrt{Ka}}.$$

The relation between the pressure Pgo at the outlet 19 of the pressure regulator 5 and the pressure Pai in the inlet section 8 of the injector 2 is represented by the following equation.

$$Pgo=Pai+\Delta P \quad (5)$$

This indicates that there is a difference of ΔP between Pgo and Pai. Substituting equation (5) in equation (4) gives $$M = K\sqrt{\frac{Pai - Pn}{Pgo - Pn}} = K\sqrt{\frac{Pai - Pn}{Pai - Pn + \Delta P}} = K\sqrt{\frac{1}{1 + \frac{\Delta P}{Pai - Pn}}} \quad (6)$$

Thus, equation (6) is obtained. If, therefore, the outlet pressure Pgo on the fuel side is equal to the inlet pressure Pai on the air side so that ΔP may be zero, then excess air ratio has nothing to do with the flow rate and can be determined by the size and shape which can be predetermined.

The pressure regulator 5 controls the degree of opening of the control valve so that ΔP in equation (5) may be zero. With the pressure on the fuel side and the pressure in the injector inlet section 8 acting on the main diaphragm 20, if the pressure on the fuel side is increased, the diaphragm is moved in a direction to close the valve body 16, whereas if the pressure on the air side is increased, the diaphragm is moved in a direction to open the valve body 16. Thus, in each case, such pressure change acts in a direction to eliminate the pressure difference. ΔP in equation (5), which cannot be made zero in a true sense, will be described with reference to FIGS. 4 and 5.

Figure 4:
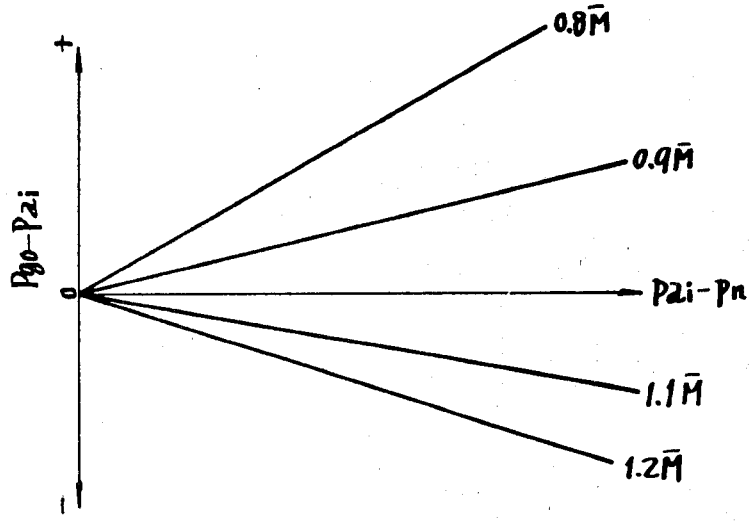
FIGS. 4 and 5 are graphs showing the influences of the produced effective pressure difference and the performance of a pressure regulator on excess air ratio.
Figure 5:
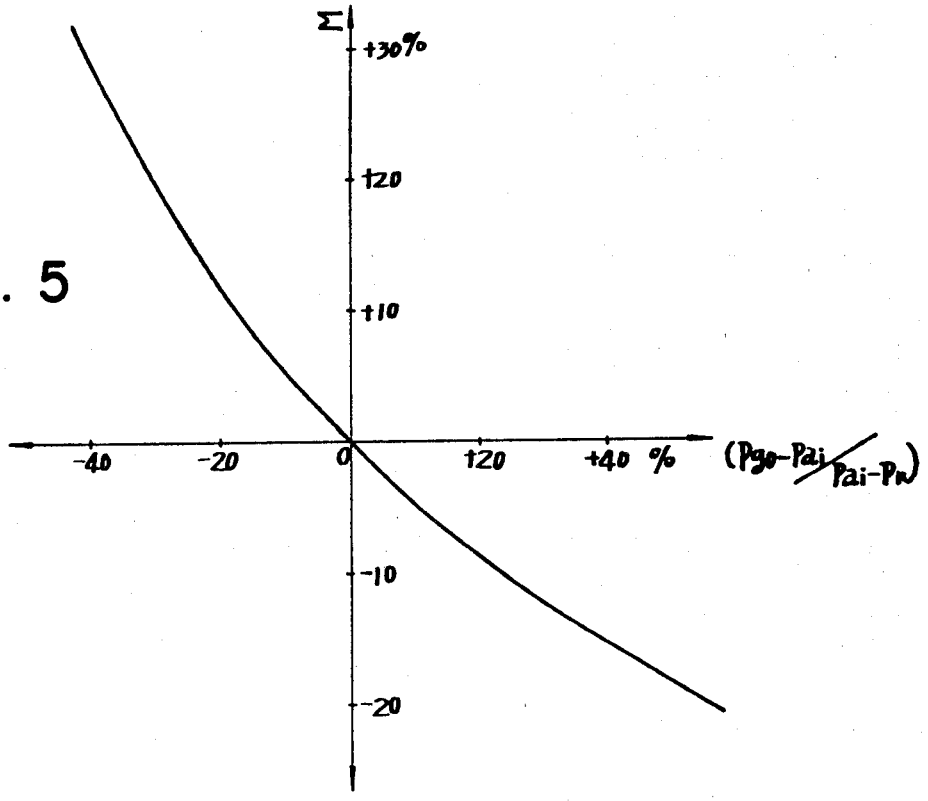

FIG. 4 shows the relation between the produced effective pressure difference Pai–Pn produced in the injector 2 and ΔP which indicates particular excess air ratios which are 10% and 20% greater (plus) and smaller (minus) than a reference excess air ratio M for which ΔP (=Pgo–Pai) in equation 5 is zero. As indicated also by equation (6), the greater the produced effective pressure difference, the greater the value of ΔP which brings about variations in excess air ratio. Conversely, if the value of ΔP is constant, the smaller the produced effective pressure difference, the more widely the value of excess air ratio varies. FIG. 5 shows this relation in a different way. It shows how much the excess air ratio M varies from the reference state in relation to the ratio of Pgo–Pai (i.e., ΔP) to Pai–Pn. In addition, it is preferable that ΔP be adjusted to be within the range of from +50% to −30% of the pressure difference produced between the inlet section of the injector and the constricted section on the basis of the amount of primary air at the time of the lowest input.

Causes for the occurence of ΔP will now be described. To describe them is, after all, to consider the difference between the air pressure in the back pressure chamber 23 of the pressure regulator 5 and the fuel pressure at the outlet 19. First, the fuel feed pressure, in the case of a gas, differs according to whether it is natural gas or LP gas, and it also differs between the time the pressure drop in the pipeline is associated with much demand for gas and the time it is associated with less demand for gas. For this reason, it is said that the actual feed pressure varies more than 6 times considering the difference in gas quality. As shown in FIG. 1, a method is employed for eliminating the influences of the feed pressure variations by using a balance diaphragm 24 having substantially the same effective area as the valve port 15 so as to establish balance between the force on the diaphragm 24 tending to close the valve body 16 and the force thereon tending to open it. In practice, however, it is difficult to achieve perfect balance. This is because, when the fuel feed pressure changes the degree of opening of the valve body 16 varies. As a result, the position in which the balance diaphragm 24 is working varies and hence its effective diameter also varies. As in industrial applications, when the gas is fed under a predetermined pressure, this influence may not be taken into consideration.

Figure 6:
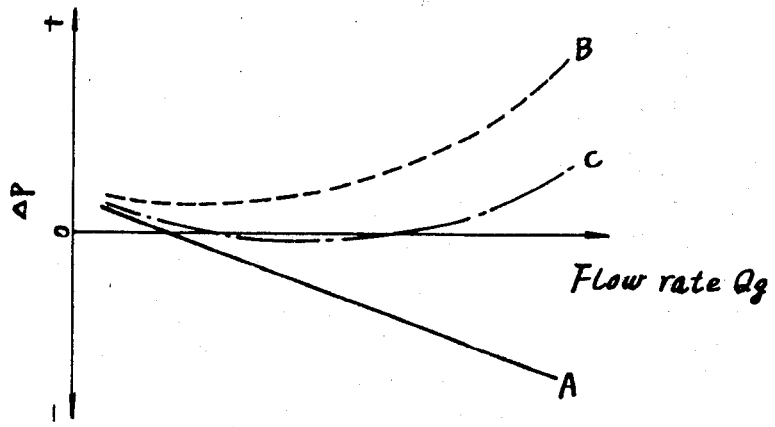
FIGS. 6 and 7 are graphs showing the relation between the flow rate provided by the pressure regulator and outlet pressure variations.
Figure 7:
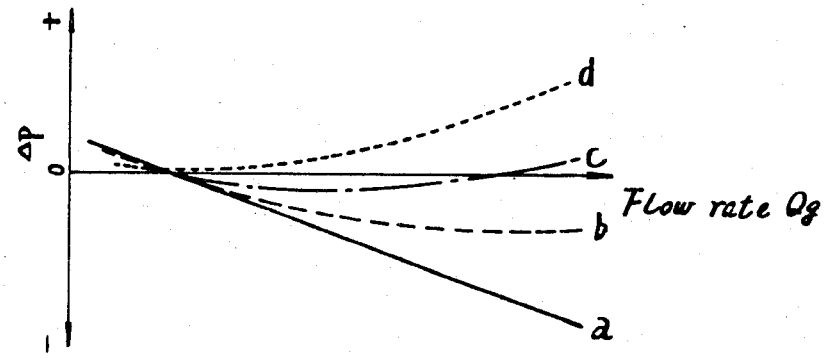

Another cause is the influence of variations in the fuel flow rate. There are two cases, one where with the same combustion apparatus used, its input is to be changed for the purpose of input control and the other where even if the input is the same, the flow rate changes with the gas quality. For example, if the input is controlled to $\frac{1}{3}$, the flow rate will change 15 to 18 times. Generally, in a gas pressure regulator, it is known that as the flow rate increases, the outlet pressure lowers. This is due to the fact that the pressure loss in the regulator increases with increasing flow rate and that the effective area of the main diaphragm and the spring load vary as the diaphragm is moved in a direction to open the valve body. This is indicated, for example, by the line A in FIG. 6. That is, even if a pressure adjustment is made at a certain point, the outlet pressure lowers as the flow rate increases. The pressure regulator 5 in FIG. 1 is designed to remedy this tendency so as to decrease said ΔP. The diaphragm chamber 22 is acted upon not by the pressure at the outlet 19 but by the pressure in the low pressure section 21 of the pressure difference producer 18. In FIG. 6, A designates a pressure difference between the pressure in the diaphragm chamber 22 and the pressure in the chamber 23, B designates a pressure difference between the pressure in the valve chamber 17 and that in the chamber 23, and C designates a pressure difference between the pressure at the outlet 19 and that in the chamber 23. By applying a pressure produced by the pressure difference producer 18 and being lower than the outlet pressure to the diaphragm chamber the pressure in the valve chamber 17 is increased. A pressure loss through the producer 18 is increased. A pressure loss through the producer 18 is given by B-C, and a pressure difference between the low pressure section 21 and the outlet 19 is given by C-A, both being the second power function of the flow rate as seen in FIG. 6. The increase of the flow rate opens the valve body 16 and lowers the outlet pressure for the reason described above, but this is compensated by applying a lower pressure than the outlet pressure to the diaphragm. The degree of this compensation depends on the characteristic of the pressure difference producer, and characteristics as indicated by lines a to d in FIG. 7 can be optionally selected. In making such compensation with the combustion control apparatus of the present invention, the following manner is most suitable.

As described with reference to FIG. 4, it is when the produced effective pressure difference in the injector 2 is small that matters most. In other words, it is when the amount of air for combustion is small and hence the flow rate of fuel is low that matters most. Therefore, it should be so arranged that with the fuel flow rate which corresponds to the lowest input, ΔP is minimum. In ordinary homes with LP gas or city gas is used, it is preferable that a pressure difference producer be provided which compensates for outlet pressure variations due to flow rate variations between the LP gas flow rate and the city gas flow rate which correspond to the lowest input. Experimentally, it has been found that ΔP takes the following values.

| | Unit mm Aq Without pressure difference producer | | Inner pressure in low pressure section 21 of pressure difference producer 18 | | | |
|---|---|---|---|---|---|---|
| | | | ϕ9 | | ϕ8.25 | |
| Influence of flow rate variations due to gas quality difference at the time of lowest input | +1.2 ↓ −0.3 | range of variation 1.5 | +0.5 ↓ −0.5 | range of variation 1.0 | +0.5 ↓ −0.2 | range of variation 0.7 |
| Influence of flow rate variations due to input variation using the same gas quality | −0.3 ↓ ↓ −5.3 | 5.0 | −0.7 ↓ ↓ +0.8 | 1.5 | −0.2 ↓ ↓ +3.6 | 3.8 |
| Influence of flow rate variations including input variation and gas quality variation | +1.2 ↓ ↓ −5.3 | 6.5 | −0.7 ↓ ↓ +0.8 | 1.5 | −0.2 ↓ ↓ +3.6 | 3.8 |

The range of input variation is up to $\frac{1}{3}$. According to this experiment, not only is ΔP itself decreased but also flow rate variations due to gas quality at the time of the lowest input are decreased. As for the influence of flow rate variations due to gas quality at the time of the lowest input, the result from ϕ8.25 is more preferable, but in this case, since the pressure loss associated with the pressure regulator 5 is increased and hence ΔP will increase when the feed pressure is decreased, in the case of domestic use, the causes for the occurrence of ΔP so far described must be considered comprehensively. Other causes for the occurrence of ΔP include variations in the pressure adjusted by the adjusting screw 26 during manufacture and in the rigity of the diaphragm due to temperature.

The main causes of ΔP indicated by equation (5) have been described so far. In the pressure regulator 5, as described above, excess air ratio varies as shown in FIG. 5. Suppose that the pressure difference Pai–Pn produced by the injector in connection with the amount of air at the time of the lowest input is 5 mm aq. and that the allowable range of the excess air ratio M is from +20% to −20% depending upon the conditions of the burner. Then, ΔP must be so controlled that its value is between −1.56 mm aq. and +2.81 mmaq. and more preferably between −1.5 mmaq. and +1.5 mmaq. This ΔP range must be maintained under any circumstances.

In this connection, if the pressure difference produced in the injector 2 with the same amount of air can be increased, then it follows that ΔP may be greater. In this respect also, however, there are limitations, since increasing the pressure difference Pai–Pn involves increasing not only the size of the blower with an attendant increase in the pressure loss through the injector but also the absolute value of Pai. In domestic gas piping, however, the feed pressure is limited and particularly in the case of city gas it is said that the feed pressure sometimes lowers down to 50 mm aq. Further, if the air feed and exhust pipes open to the outside air, wind of 20 m/sec hitting them can cause an internal pressure increase of 15 to 20 mm aq. Since this internal pressure increase results in increasing the absolute value of Pai, it follows that the feed gas pressure is lowered by 15 to 20 mm aq. if it is considered as ΔP represented by Pgo–Pai. As a result, even if the valve body 16 of the pressure regulator 5 is fully opened, Pgo is still less than Pai, so that the insufficient amount of gas causes an increase in excess air ratio. Accordingly, unless the gas is fed from a booster or a medium pressure gas piping as in industrial applications, ΔP cannot be reduced to zero even if a large blower is used. For domestic applications, it is important to increase the effective pressure difference Pai–Pn without increasing the pressure Pai in the inlet section 8 of the injector 2, and the invention resides in this point.

The injector 2 is arranged as shown in FIG. 2. Since the direction of air flow vectorially concides with the direction of gas or fuel flow, disturbance due to interference between the two fluids can hardly occur and the loss of kinetic energy can be reduced as compared with a venturi mixer for industrial use where the direction of of air flow is perpendicular to the direction of gas flow. This is advantageous where mixing takes place in a portion where a pressure loss is liable to occur, as in the constricted section 10.

With the inner diameter D of the constricted section 10 constant, the relation between its length lt, the outer diameter d of the fuel injecting port and pressure loss will now be described. The pressure loss referred to herein is represented by the following equation.

$$ploss = Pai - Pao \tag{7}$$

Pao: Pressure of air just leaving enlarged section 11

Ploss: Pressure loss through injector 2

Figure 8A:
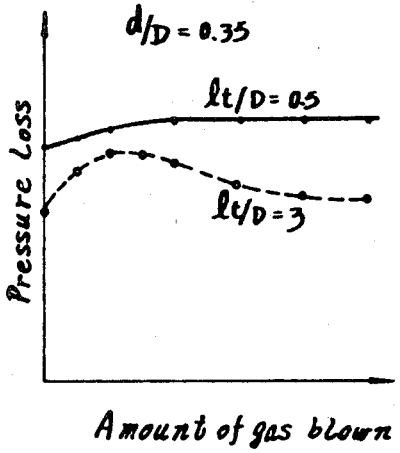
FIGS. 8A, 8B, 9, 10 and 11 illustrate the influences of the various factors of the injector.
Figure 8B:
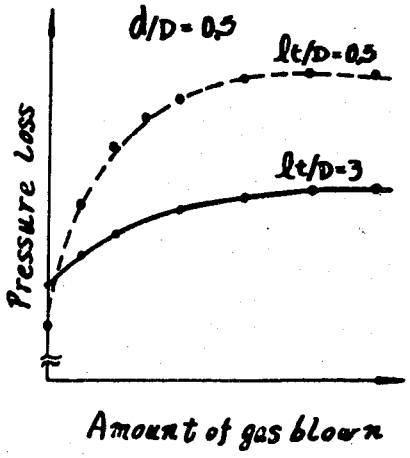

FIGS. 8A and 8B show the relation between the pressure loss and the amount of gas blown when a fixed amount of air is flowing while the amount of gas from the fuel injecting port 12 is being gradually increased. When there is no gas being blown, the pressure loss is small, and an experiment using a lower rate of blow of gas than the rate of blow of air has revealed the tendency of the pressure loss to increase with increasing amount of gas. When d/D is large and hence the air blowing area is small, the pressure loss is large and variations due to the amount of gas are also large. The pressure loss, of course, varies with lt/D, and the tendency of variation due to the amount of gas also varies. The pressure efficiency η associated with the injector 2 will now be considered.

$$\eta = \frac{(Pai - Pn) - Ploss}{Pai - Pn} = \frac{Pao - Pn}{Pai - Pn} \tag{8}$$

Figure 9:
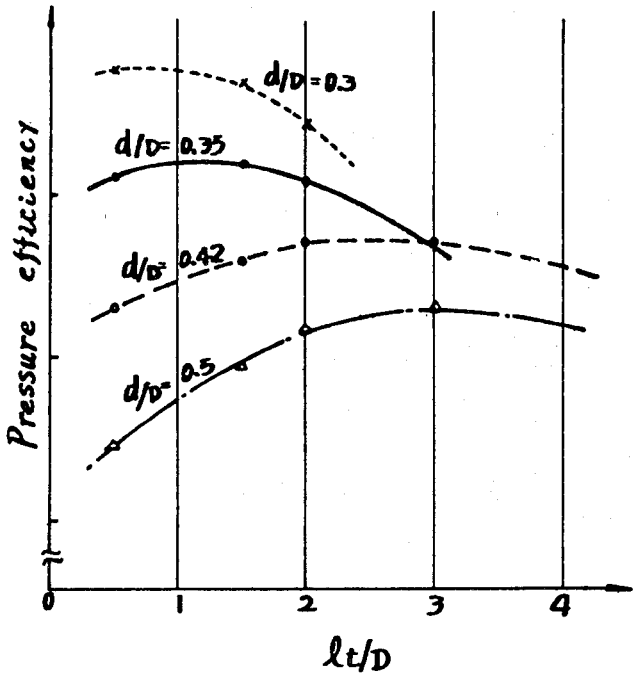
Figure 10:
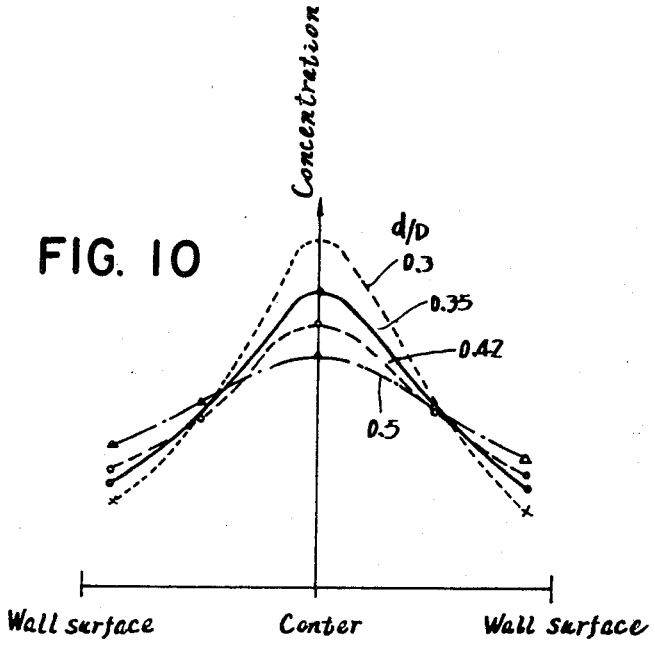
Figure 11:
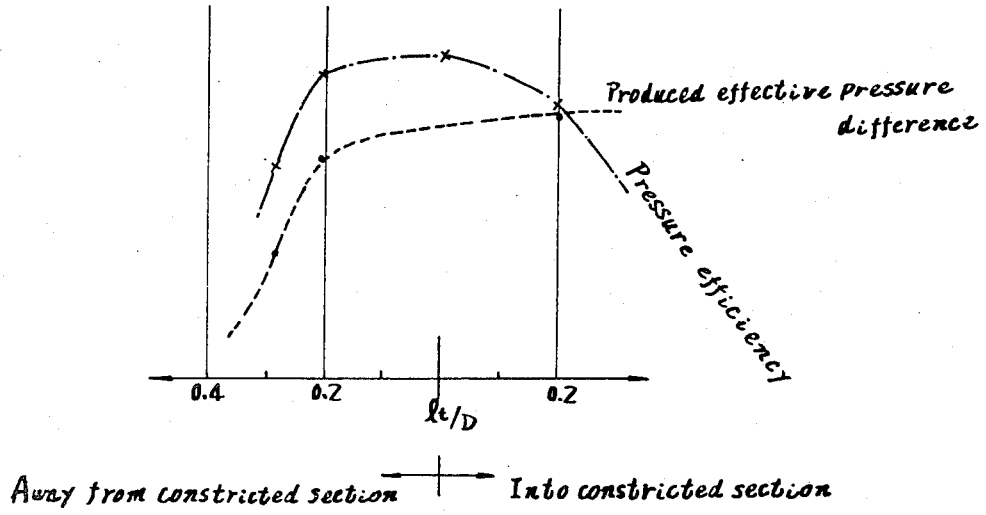

It is preferable that this efficiency η be high as much as possible. An experiment has given the result shown in FIG. 9. As shown therein, the efficiency is increased as d/D is decreased. As for the point at which the efficiency with respect to lt/D is highest, lt/D increases as d/D increases. FIG. 9 has been prepared by conducting an experiment such as in FIG. 8 so as to find the actual effective Pai–Pn at respective amounts of gas blown and calculate pressure efficiency curves therefrom and from associated pressure losses, and plotting points where the efficiency is lowest. If d/D is set at a small value, then the pressure efficiency η is high and lt/D can be decreased, which is advantageous. However, in domestic applications, Pai cannot be made so high for the reason described above and hence Pgo is also low, so that there is a limitation that in order to provide at least a required rate of flow of fuel, d cannot be made so small. Further, FIG. 10 illustrates distributions of concentration of air and gas passing through the enlarged section 11 of the injector 2, wherein d/D at given lt/D is used as a parameter. The result is that the greater d/D, the more uniform the distribution of concentration. At the burner 3, besides the excess air ratio being within the predetermined range, it is desired that the excess air ratio be controlled for each flame hole. Although the uniformization of the distribution of concentration will be enhanced between the injector 2 and the burner 3, it goes without saying that it is preferable to enhance it at the injector 2 itself. From these experimental results, it has been found that lt/D being 0.5 to 3 and d/D being 0.3 to 0.5 are optimum from the standpoint of the pressure efficiency and the distribution of concentration. The positional relation between the discharge end of the fuel injecting port 12 and the constricted section 10 will now be described. With the distance between said end and a transverse plane through the inlet end of the constricted section 10 represented by ln, the resulting pressure loss and produced effective pressure difference were as shown in FIG. 11. Thus, it is seen that as the distance from the discharge end to the transverse plane increases, the produced effective pressure difference tends to decrease and when the distance is more than 25% of the inner diameter of the constricted section, it sharply lowers. Further, when said end is entered into the constricted section beyond the transverse plane, since the area of blow of air remains unchanged the produced effective pressure difference will not lower: Rather, it increases by an amount corresponding to the friction. However, the pressure efficiency begins to lower. Therefore, the conclusion is that as to the position where at least a predetermined produced effective pressure difference is obtained and the pressure efficiency is high, it is preferable that the end of the fuel injecting port 12 be positioned 0.25 times the diameter of the constricted section apart upstream or downstream from said transverse plane. As for the enlarged section 11, the result obtained is that, as is generally known, an enlarging angle of about 8 degrees produces a minimum pressure loss.

The injector 2 is arranged with the above factors taken into account, making it possible to obtain a large produced effective pressure difference while decreasing the pressure loss. Thus, it has become possible to provide an apparatus which is capable of satisfactorily controlling excess air ratio even when the gas pressure is low. In the case of gas, the flow rate of fuel differs even if the input is the same, but in that case the constant Kg indicated in equation (2) may be changed. Concretely, the orifice 13 alone shown in FIG. 1 is replaced to cope with the situation. The pressure regulator 5 and the injector 2 need not be changed even if the gas quality is changed. If an on-off valve is to be inserted on the fuel side in order to turn on and off the input according to the need, it is preferable to insert it midway between the pressure regulator 5 and the injector 2, as shown in FIG. 1, since, considering cases where the gas pressure in domestic applications has lowered, in order to maintain $\Delta P$ equal to zero, the feed pressure entering the pressure regulator must be higher than Pai. This means that the pressure loss upstream of the pressure regulator 5 must be reduced as much as possible. The solenoid on-off valve is attended with a pressure loss of several mm aq. to several ten mm aq. and this is considered as a leading factor in determining the constant Kg indicated in equation (2). Accordingly, the arrangement shown in FIG. 1 is effective to lessen the variation of excess air ratio with respect to the lowering of the gas pressure. Supposing the pressure loss of the solenoid on-off valve to be, for example, 10 mm aq., let us consider what the gas pressure is which causes the 20% excess air ratio to increase with respect to the excess air ratio associated with a gas pressure of 100 mm aq. If a pressure of 60 mm aq. exists when it is disposed upstream of the pressure regulator 5, then it follows that the arrangement of FIG. 1 can withstand gas pressure drops to the limit of 50 mm aq.

According to the control apparatus of the invention, since the flow rate of fuel can be controlled in connection with the amount of air for combustion, it becomes possible to control the input simply by controlling the amount of air from the blower 1. For domestic applications in general, it is necessary from the standpoint of ease of use and the saving of energy that the input can be controlled in accordance with the load. In this respect, the apparatus of the invention may be said to be easy to control.

In addition, in FIG. 1, air is fed as primary air, but if secondary air is required, it may be fed from the air feed passage 4 through a branch directly to the burner 3. In that case also, the ratio between the primary air, secondary air and fuel flow rate can be maintained constant since the ratio between the primary air and secondary air can be predetermined.

Thus, according to the invention, even if there are variations in the input, in the fuel feed pressure and in the outside wind pressure, the excess air ratio can be maintained substantially constant to provide for perfect combustion and, moreover, the lowering of efficiency during low input is avoided. Particularly, since the apparatus is adapted for use at low pressures by increasing the pressure efficiency in the air-fuel mixing section, not only is the blower small in size but also the apparatus is suitable for domestic use.

We claim:

1. A combustion control apparatus comprising:

a premix combustion burner;

a primary air feed passage for supplying primary air;

an injector disposed between the primary passage and the burner and comprising, from upstream to downstream, an air passage having an inlet section for introducing air thereinto, a flow contracting section having its inner diameter progressively decreasing as it extends downstream, a constricted section of substantially a constant inner diameter at any section thereof and having a length of 0.5 to 3 times its inner diameter, and an enlarged section communicating with the constricted section and having its inner diameter gradually increasing as it extends downstream to the burner;

a fuel injecting nozzle arranged coaxially with the constricted section of the injector, said nozzle having a discharge end facing downstream and disposed in the vicinity of a transverse plane passing through the upstream end of the constricted section whereby the fuel and air are mixed in said enlarged section of the injector, said nozzle having at the downstream end thereof an outer diameter of 0.3 to 0.5 times the inner diameter of the constricted section;

a fuel feed passage communicating with the nozzle;

a pressure regulator disposed in the fuel feed passage and comprising a valve port, a valve body for controlling the degree of opening of the valve port, a pressure difference producer disposed downstream from the valve port and having low pressure section means for producing a pressure lower than the outlet pressure from the pressure regulator, a balance diaphragm disposed in opposed relation with the valve port and having an area substantially equal to the area of the valve port, a main diaphragm having an area larger than the area of the balance diaphragm, said two diaphragms being connected to the valve body, said low pressure section means communicating directly with a diaphragm chamber defined between the two diaphragms, a back pressure chamber on the side of the main diaphragm opposite to the valve port;

an equalizing pipe for introducing the pressure in the inlet section of the injector into said back pressure chamber; and an orifice arranged in the fuel feed passage between the regulator and the nozzle.

2. A combustion control apparatus as set forth in claim 1, wherein a fuel on-off valve is disposed in the fuel feed passage between the fuel injecting nozzle and the pressure regulator.

* * * * *

UNITED STATES PATENT AND TRADEMARK OFFICE

CERTIFICATE OF CORRECTION

PATENT NO. : 4,385,887

DATED : May 31, 1983

INVENTOR(S) : YOSHIO YAMAMOTO ET AL

It is certified that error appears in the above—identified patent and that said Letters Patent is hereby corrected as shown below:

Column 2, line 15, "22" should read -- 12 --.

Signed and Sealed this

*Thirteenth* Day of *December 1983*

[SEAL]

*Attest:*

GERALD J. MOSSINGHOFF

*Attesting Officer*

*Commissioner of Patents and Trademarks*